US012654977B2

(12) United States Patent
Michelsson et al.

(10) Patent No.: US 12,654,977 B2
(45) Date of Patent: Jun. 16, 2026

(54) REEL STAND

(71) Applicant: AB FINLANDIA AUTOMATION OY, Espoo (FI)

(72) Inventors: Nils Johan Michelsson, Espoo (FI); Kari Santeri Santavirta, Espoo (FI)

(73) Assignee: AB FINLANDIA AUTOMATION OY, Espoo (FI)

( * ) Notice: Subject to any disclaimer, the term of this patent is extended or adjusted under 35 U.S.C. 154(b) by 78 days.

(21) Appl. No.: 18/707,081

(22) PCT Filed: Nov. 2, 2022

(86) PCT No.: PCT/FI2022/050716
§ 371 (c)(1),
(2) Date: May 2, 2024

(87) PCT Pub. No.: WO2023/079211
PCT Pub. Date: May 11, 2023

(65) Prior Publication Data

US 2025/0033921 A1 Jan. 30, 2025

(30) Foreign Application Priority Data

Nov. 3, 2021 (FI) ..... 20216132

(51) Int. Cl.
*B65H 49/32* (2006.01)
*B65H 16/06* (2006.01)
(Continued)

(52) U.S. Cl.
CPC ..... *B65H 49/32* (2013.01); *B65H 49/26* (2013.01); *B65H 49/325* (2013.01); *B65H 75/34* (2013.01);
(Continued)

(58) Field of Classification Search
CPC ..... B65H 49/00; B65H 49/20; B65H 49/205; B65H 49/26; B65H 49/32; B65H 49/321;
(Continued)

(56) References Cited

U.S. PATENT DOCUMENTS 341,891 A * 5/1886 Crawford ..... B65H 49/32
242/129.62
366,909 A * 7/1887 Wirt ..... B65H 75/403
242/391.1
(Continued)

FOREIGN PATENT DOCUMENTS

AU 3248184 A 3/1985
AU 2012261554 A1 * 6/2013 ..... B65H 49/20
(Continued)

OTHER PUBLICATIONS

Aug. 20, 2025 Search Report issued in European Patent Application No. 22889512.4, pp. 1-6.
(Continued)

*Primary Examiner* — Victoria P Augustine
*Assistant Examiner* — Raveen J Dias
(74) *Attorney, Agent, or Firm* — Nixon & Vanderhye PC

(57) ABSTRACT

To obtain a reel stand, the displacement of which during use may be easily prevented, the reel stand includes a unitary, substantially U-shaped frame having first and second branches. Both branches include a planar section, the planar sections together defining a plane, and a support section including first and second rod sections that together form an angle. Both rod sections connect to the planar section through the first rod section. The second rod section includes an end located on the plane defined by the planar sections. First and second support members are provided coaxially in the first and second branch, the first and second support member extending from the first and the second branch
(Continued)

towards each other at the support sections to form a contact with openings on side flanges of a reel to be arranged between them, to receive the reel in the reel stand in a rotating manner.

11 Claims, 2 Drawing Sheets

(51) Int. Cl.
*B65H 49/26* (2006.01)
*B65H 75/34* (2006.01)
*B65H 75/40* (2006.01)

(52) U.S. Cl.
CPC ..... *B65H 75/40* (2013.01); *B65H 16/06* (2013.01); *B65H 2301/4134* (2013.01); *B65H 2701/34* (2013.01)

(58) Field of Classification Search
CPC .... B65H 49/324; B65H 49/325; B65H 49/18; B65H 75/00; B65H 75/20; B65H 75/34; B65H 75/40; B65H 75/406; B65H 16/00; B65H 16/02; B65H 16/06; B65H 16/106; B65H 2301/413; B65H 2301/4134; B65H 2701/30; B65H 2701/32; B65H 2701/33; B65H 2701/34; B65H 2701/35; B65H 2701/36; B65H 75/35
USPC ..... 242/588, 590, 596, 596.3, 598
See application file for complete search history.

(56) References Cited

U.S. PATENT DOCUMENTS 958,062 A * 5/1910 Adkins ..... B65H 49/32 242/598.5
1,648,568 A * 11/1927 Stoffel ..... B65H 75/403 242/391.1
1,899,117 A * 2/1933 Sheeley ..... B65H 49/32 242/607.1
2,292,895 A * 8/1942 Mohr ..... B42D 19/00 281/2
3,304,060 A * 2/1967 Davenport ..... B21C 47/24 254/131
3,337,153 A * 8/1967 Heymann ..... B65B 13/185 242/588
3,341,149 A * 9/1967 Graham ..... B65H 54/553 242/391
3,544,031 A 12/1970 White
4,137,939 A * 2/1979 Chow ..... B65H 75/403 137/355.27
4,277,034 A * 7/1981 Buzzell ..... B65H 23/16 242/598.5
4,548,368 A * 10/1985 Tomlinson ..... B65H 49/32 55/385.2
4,746,078 A * 5/1988 Setzke ..... B65H 49/321 242/129.6
4,752,047 A * 6/1988 Franks, Jr. ..... B65H 49/26 242/129.6
5,056,553 A 10/1991 Whitehead et al.
5,333,808 A * 8/1994 Klumpjan ..... B65H 49/32 242/129
5,775,621 A * 7/1998 Sauber ..... B65H 49/32 242/391.1
7,461,809 B1 * 12/2008 Maley ..... B65H 49/32 242/557
2002/0038837 A1 * 4/2002 Jackson ..... B65H 49/32 242/598.2
2004/0200921 A1 * 10/2004 Chapman ..... B65H 75/4434 242/396.6
2005/0045759 A1 * 3/2005 Hibbs ..... B65H 49/305 242/588.2
2005/0284878 A1 * 12/2005 Yu Chen ..... B65H 16/005 242/564.2
2009/0008492 A1 * 1/2009 Phillips ..... B65H 49/32 242/129
2009/0065663 A1 * 3/2009 Jordan ..... B65H 49/321 248/157
2017/0197802 A1 * 7/2017 Yu Chen ..... B65H 59/04
2020/0324922 A1 * 10/2020 Straubel ..... B64G 1/2225
2024/0150150 A1 * 5/2024 Borello ..... B65H 57/18
2024/0174476 A1 * 5/2024 Becerra Alvarado .. B65H 49/32

FOREIGN PATENT DOCUMENTS

CA 2974026 C * 12/2020 ..... B65H 75/32
CN 114030941 A * 2/2022 ..... B65H 57/06
EP 0600770 B1 * 7/1996 ..... B65H 57/14
GB 895715 A 5/1962
GB 2069444 A * 8/1981 ..... B65H 59/381
GB 2152900 A 8/1985
GB 2256632 A * 12/1992 ..... B65H 75/14
JP S56144062 A 11/1981
JP S6283986 A 4/1987
JP H0920465 A * 1/1997 ..... B65H 49/32

OTHER PUBLICATIONS

International Search Report for PCT/FI2022/050716, mailed Jan. 26, 2023, 5 pages.
Written Opinion of the ISA for PCT/FI2022/050716, mailed Jan. 26, 2023, 7 pages.
International Preliminary Report on Patentability w/Amended Sheets for PCT/FI2022/050716, mailed Mar. 4, 2024, 30 pages.
Finnish Search Report for FI 20216132, dated Apr. 27, 2022, 2 pages.

* cited by examiner

REEL STAND

CROSS-REFERENCE TO RELATED APPLICATIONS

This application is the U.S. national phase of International Application No. PCT/FI2022/050716 filed Nov. 2, 2022, which designated the U.S. and claims priority to FI 20216132 filed Nov. 3, 2021, the entire contents of each of which are hereby incorporated by reference.

BACKGROUND OF THE INVENTION

Field of the Invention

This invention relates to a reel stand which is arranged for receiving a reel in a rotating manner.

Description of Prior Art

In many technical chores, for example in relation to electrical and IT-installations, there is often demand for equipment for feeding reeled or spooled articles, such as cables or wires, is a controlled manner from the reel to the location of installation. For this purpose, it is known to use different racks and stands for receiving the reels, in which the received reel can rotate for feeding the cable as a result of the cable being pulled.

A problem often occurring during use of said known stand models is related to their light-weight structure, which may result in the stand being displaced or toppled as a result of the cable being pulled from the reel placed in the stand.

On the other hand, fabricating the reel stand into a sufficiently heavy structure renders the stand difficult to move and may cause additional costs, rendering the stand poorly suited for its purpose. Additionally, the manufacture of the known stand models typically comprises several manufacturing steps, such as bending and welding of the raw material, thereby further increasing the manufacturing costs.

SUMMARY OF THE INVENTION

An object of the present invention is to solve the previously described problems and to provide a reel stand that is inexpensive and easy to manufacture and enables easy prevention of displacement during use. This object is achieved with a reel stand according to independent claim 1.

By forming the reel stand by a substantially U-shaped frame, wherein a first and a second branch have a planar section and an end located on a plane defined by the planar sections, a reel stand is obtained that can be arranged rigidly on a surface during use and that is easy to move.

BRIEF DESCRIPTION OF DRAWINGS

In the following the present invention will be described in closer detail by way of example and with reference to the attached drawings, in which.

DESCRIPTION OF AT LEAST ONE EMBODIMENT

Figure 1:
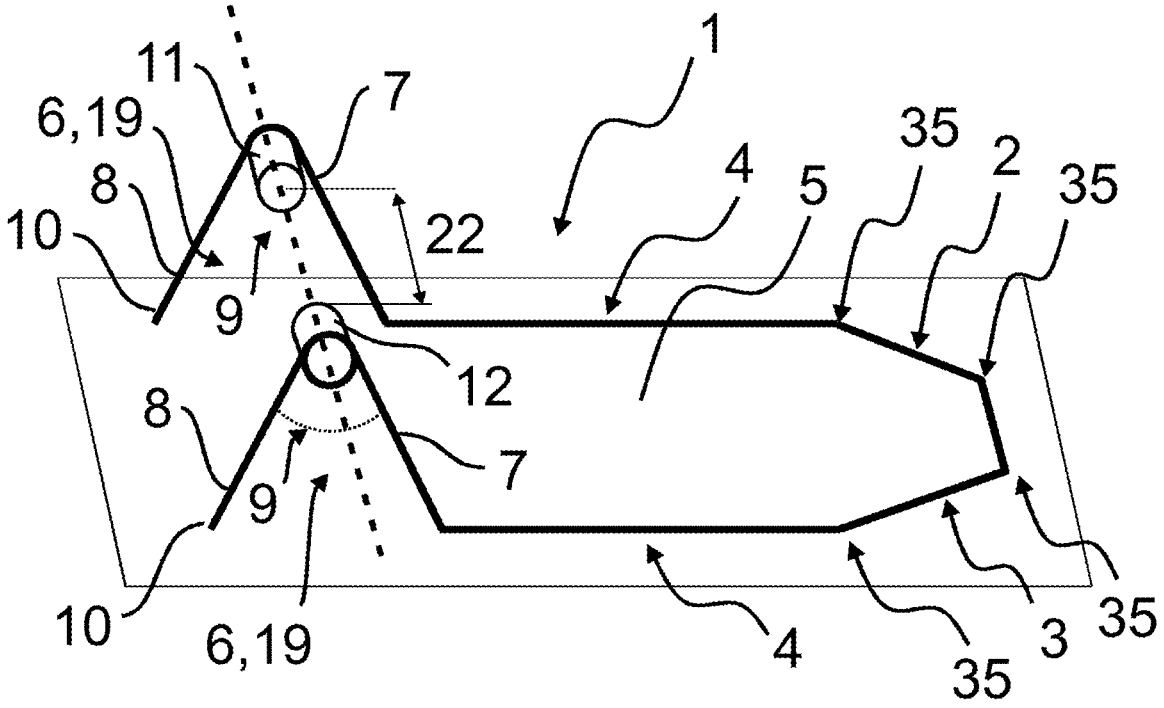
FIG. 1 illustrates an oblique projection of the reel stand.
Figure 2:
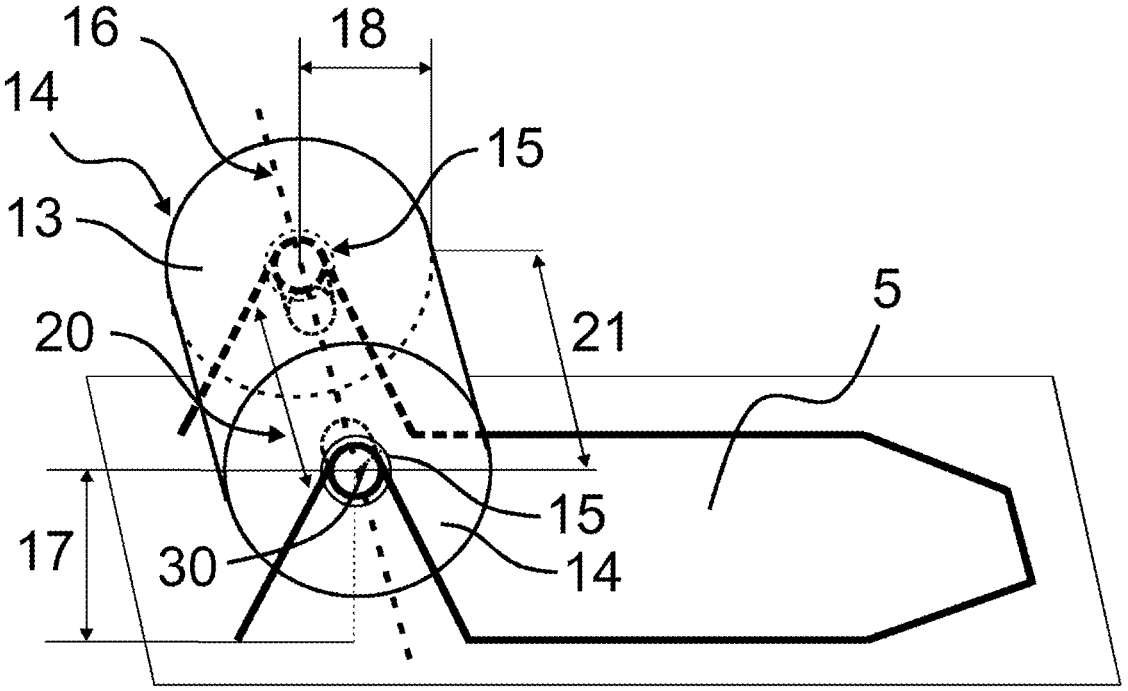
FIG. 2 illustrates an oblique projection of the reel stand of FIG. 1 and a reel arranged thereto.

The structure of the reel stand is illustrated in the example of FIGS. 1 and 2, wherein the reel stand comprises a unitary, substantially U-shaped frame 1 having a first branch 2 and a second branch 3. As illustrated in the figures, the frame 1 is formed of a singular piece that is narrow relative to its length, which piece may be, for example, a pipe or a rod. Said structure enables manufacture of the frame 1 by only bending said piece forming it, such that no other manufacturing steps, for example for joining together separate structural elements, are needed. In other variations of the reel stand, the shape and proportions of the piece used for forming the frame 1 may, however, deviate from the example of FIGS. 1 and 2, such that the structure of the frame 1 may be thicker or narrower than illustrated in the figures.

In the example of FIGS. 1 and 2, the U-shape of the frame 1 is formed by four angular points 35, wherein at each angular point 35 the piece forming the frame is bent in one direction that is the same at all of the angular points 35, such that the angular points together form a substantially 180 degree turn at the middle section of the piece, wherein a first 2 and a second branch 3 are formed in the piece on different sides of said turn. In other variations of the reel stand, the number of the angular points 35 may deviate from the example of FIGS. 1 and 2, wherein their number is at least two, or instead of the angular points 35, the turn between the branches 2, 3 may be implemented as a singular, continuous turn.

Furthermore in the example of FIGS. 1 and 2, both branches 2, 3 of the frame comprise a planar section 4, said planar sections extending parallel to each other from the turn defined by the angular points 35, such that they together define a plane 5. Said plane 5 is thereby formed such that it extends in the direction of extension of the planar sections 4 and touches both planar sections 4 simultaneously. With said arrangement, a rigid arrangement of the frame 1 on a surface, such as a floor, is achieved, thereby inhibiting displacement or toppling of the reel stand during use. The described shape of the frame 1 also enables an additional load to be placed on top of the planar sections 4, thereby further hampering the movement of the frame 1 relative to the surface, such as a floor, as a consequence of the added load. Thereby, the reel stand is well suited to be set on a horizontal surface, such as a floor, in which case its firm placement can be further advanced by using the added load placed on top of the planar sections 4 of the frame branches. By utilizing separate fasteners, the reel stand may also be set on, for example, a vertical surface during use, for example by suspending it on a wall on hooks.

According to the example of FIGS. 1 and 2, both branches 2, 3 of the frame further comprise a support section 6 having a first 7 and a second rod section 8. The support sections 6 extend in an angle, which is preferably a right angle as illustrated in the example of FIGS. 1 and 2, in relation to the plane 5 defined by the planar sections 4. Said rod sections 7, 8 also form an angle 9 together, wherein both rod sections 7, 8 connect to the planar section 4 through the first rod section 7 at each of the branches 2, 3. In said arrangement, the second rod section 8 further comprises an end 10 located on the plane 5 defined by the planar sections 4. Thereby, rigidness of the frame 1 placement on the surface, such as a floor, is further improved, when at least the ends 10 and the planar sections 4 come into contact with the surface. The magnitude of the angle 9 formed by the rod sections 7, 8 may freely deviate from the example of FIG. 1 insofar that it enables the end 10 to be located on the plane 5 defined by the planar sections 4. In a preferred embodiment, the magnitude of the angle 9 is 20 to 90 degrees.

Furthermore according to the example of FIGS. 1 and 2, a first support member 11 and a second support member 12 are provided coaxially in the respective first 2 and the second branch 3 of the frame. The support members 11, 12 extend from the first 2 and the second branch 3 towards each other at the support sections 6 to form a contact with openings 15 on side flanges 14 of a reel 13 arranged between the support members 11, 12, to receive the reel 13 in the reel stand in a rotating manner as illustrated in the example of FIG. 2. In this context, the term contact means that the support members 11, 12 extend at least partially inside the openings 15 when the reel 13 has been received in the reel stand. Due to said arrangement, the reel 13 received in the reel stand is attached firmly to the reel stand, such that problems related to the reel falling from the reel stand during use are avoided. According to the FIGS. 1 and 2, the first 11 and the second support member 12 are further arranged to the first 2 and the second branch 3 at the support sections 6 such that a distance 17 of a rotational axis 16 of the reel 13 received in the reel stand from the plane 5 is greater than a radius 18 of the reel. With said arrangement, free rotation of the reel 13 in the reel stand is enabled without a contact being formed between the reel and the plane 5.

In the example of FIGS. 1 and 2, the first 11 and the second support member 12 extend from the first 2 and the second branch 3 at the support sections 6 such that each support member 11, 12 is in contact with the first 7 and the second rod section 8 of the support section 6. In other words, the support members 11, 12 are located between the rod sections 7, 8 at the angle 9 formed by them. The arrangement of the support members 11, 12 according to said example enables that by turning the reel stand and the reel 13 attached thereto upside down relative to the position illustrated in FIGS. 1 and 2, the reel stand can be easily moved by rotating the reel 13 on the surface, such as a floor. In said arrangement, the reel stand acts in the way of a carriage, wherein the reel 13 forms a wheel, and that can be pulled by, for example, an electrician while moving to the installation location. In such case, the first 2 and the second branch 3 of the frame and the turn between them form at the same time a handle-like formation that is well suited for pulling the reel stand. Alternatively, a free end of an article, such as a cable or a wire provided in the reel 13 in the reel stand may be attached to, for example, the initial end of the installation location, such that by moving the reel stand according to the previous description, the article may be fed from the reel 13 in a controlled manner by moving the reel stand.

Another benefit that is obtained by locating the support members 11, 12 in a way described above is that during the manufacture of the reel stand, the support members 11, 12 may be easily positioned by utilizing the shape of the support sections 6 without the separate steps of positioning and temporary mounting of the support members. In other variations of the reel stand, however, the support members 11, 12 may be in contact with, for example, only one of the rod sections 7, 8 and be located in which ever location along the length of the rod sections 7, 8.

In the example of FIGS. 1 and 2, the first 7 and the second rod section 8 of each support section 6 define together a support plane 19, in other words so that the first 7 and the second rod section 8 extend on the same plane relative to each other. According to said example, the distance 20 between the support planes 19 is at least equal to a width 21 of the reel 13, and furthermore a distance 22 between the first 11 and the second support member 12 is smaller than the width 21 of the reel 13, such that the shape of the reel stand is suited for receiving and holding the reel 13 between the support sections 6.

Furthermore, for arranging the reel 13 between the support members 11, 12, the frame 1 of the reel stand is formed of an elastic material such that the distance 22 between the first 11 and the second support member 12 is elastically deflectable by an external force. Thereby, by directing an external force to, for example, one branch 2, 3 of the frame or to one of the first 11 and the second support members 12 such that the force is directed away from the adjacent branch 2, 3 or support member 11, 12, the distance between the first 11 and the second support members 12 may be temporarily increased in order to facilitate the arrangement of the reel 13 between the support members 11, 12. Said elastic material may be, for example, a metal, a plastic or a composite material. In order to facilitate the increasing of the distance 22 between the support members 11, 12 during placing and removal of the reel 13, the branches 2, 3 of the reel stand are only connected at a singular location in the example illustrated in FIGS. 1 and 2.

Due to its shape, the reel stand according to the example of FIGS. 1 and 2 is also suited for use in an alternative mode in case of, for example, such continuous and bendable articles that are supplied without the reel 13. Such articles include, for example, bundled cables and tubes. In said alternative mode of use, the reel stand is placed on the surface sideways in respect to the operating position disclosed above, such that the reel stand is supported on the surface through either one of the support sections 6 and the planar section 4 connected thereto. In other words, in said operating position the support plane 19 defined by the first 7 and the second rod section 8 is placed parallel to the surface, such that these rod sections and the planar section 4 connected thereto act as a structure supporting the reel stand in said position. In this position, the reel stand is especially well suited for receiving such reels 13 that comprise only one side flange 14, wherein the reel end provided with the side flange 14 is preferably placed towards the support section 6 supporting the reel stand. The articles supplied without the reel may be easily placed in such a reel 13, which may be directly manufactured into the described shape or be provided by removing one side flange 14 of a reel comprising two side flanges. In such case, placement of the articles may be accomplished via the end of the reel that is not provided with the side flange 14. With an arrangement as described, previously described benefits of the reel stand may be utilized also in relation to such articles, without the outer dimensions of the article bundles limiting their compatibility with the reel stand.

Figure 3:
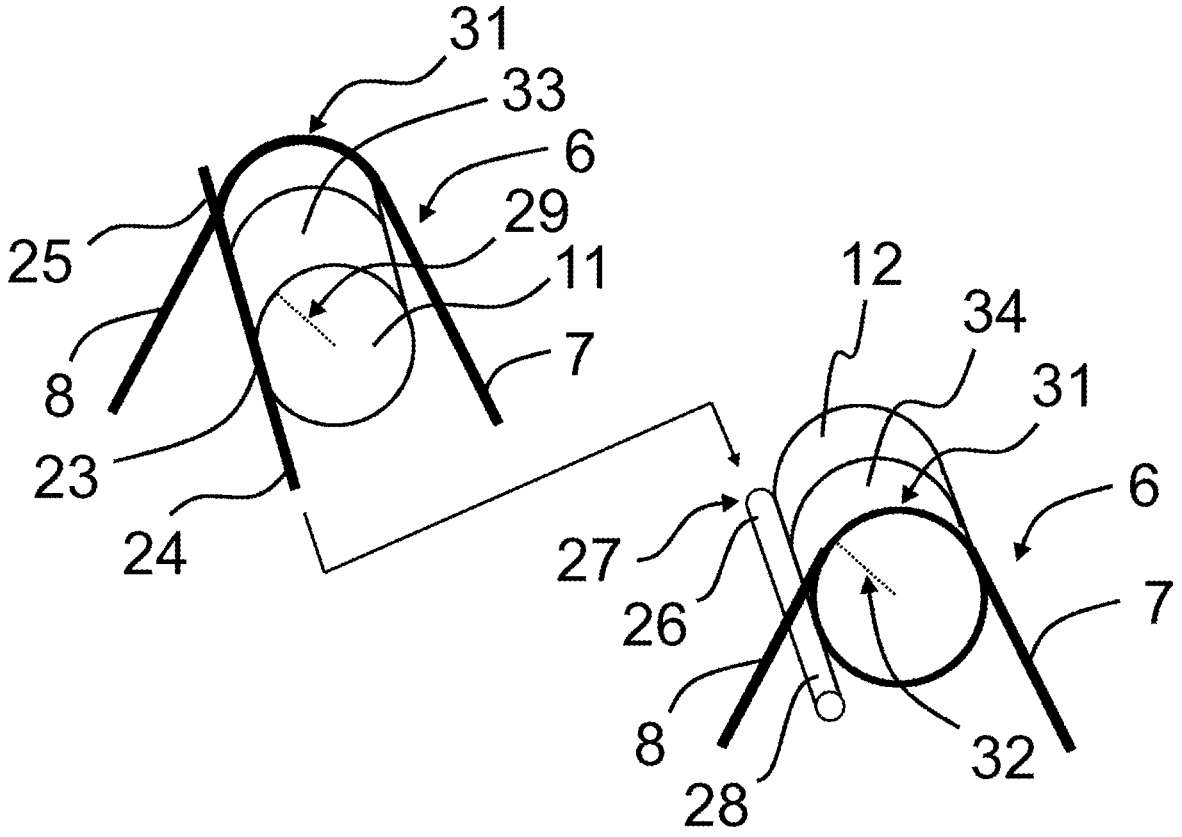
FIG. 3 illustrates an oblique projection of an additional part of the reel stand of FIGS. 1 and 2.

An additional part of the reel stand is illustrated in the example of FIG. 3, the part being suited to be used in a reel stand according to FIGS. 1 and 2.

Said additional part comprises an axle 23 that is arranged to be attached to the first support member 11, and an axle support 26 that is arranged to be attached to the second support member 12. According to said example, the axle 23 has a first 24 and a second end 25 and is arranged to be attached to the first support member 11 such that the first end 24 of the axle extends towards the second support member 12. Correspondingly, the axle support 26 is then arranged to be attached to the second support member 12 such that a recess 27 opens to the surface of the axle support 26 towards the first support member 11 for receiving the first end 24 of the axle.

The arrangement as illustrated in the example of FIG. 3 enables the reception of reels 13 to the reel stand that have a width 21 smaller than the distance between the first 11 and the second support section 12. In such case, when the reel 13 has been received to the reel stand, the axle 23 forms a contact with the openings 15 at the side flanges 14 of the reel 13 arranged between the support members 11, 12, instead of the support members 11, 12, and extends through the reel 13 between the openings 15.

In the example of FIG. 3, the second end 25 of the axle extends from the first support member 11 opposite to the first end 24 past the first support member 11, and the axle support 26 comprises a protrusion 28 extending away from the first support member 11 past the second support member 12. In said arrangement, the second end 25 of the axle and the protrusion 28 of the axle support may be brought into contact with the first 7 or the second rod section 8 of the support section 6 corresponding to their location, such that movement of the axle 23 and the axle support 26 relative to the support members 11, 12 can be inhibited. Said arrangement is not essential for the function of the reel stand, however.

Furthermore in the example of FIG. 3, the axle 23 further comprises an axle bushing 33 between the first 24 and the second end 25 of the axle, which is arranged to be placed gaplessly around the first support member 11 to attach the axle 23 to the first support member 11. Correspondingly, in said example also the axle support 26 further comprises a support bushing 34, which is arranged to be placed gaplessly around the second support member 12, to attach the axle support 26 to the second support member 12. In this context, the term gapless means that the space for movement available to the axle bushing 33 and the support bushing 34 about the support members 11, 12 is minuscule. In other variations of the reel stand, the axle 23 and the axle support 26 may be arranged to attach to the support members 11, 12 by means other than utilizing the bushings 33, 34, wherein instead of the bushings 33, 34, the axle 23 and the axle support 26 may comprise, for example, a fastening band.

In the examples of FIGS. 1 to 3, both of the first 11 and the second support member 12 are formed of a cylindrical piece, which may be hollow or solid so that an outer 29 radius of the support members is smaller than the radius 30 of the openings 15 at the side flanges 14 of the reel 13. Additionally, in said examples a rounding 31 is provided between the first 7 and the second rod section 8 of each support section 6, a rounding radius 32 of said rounding 31 substantially corresponding to the outer radius 29 of the first 11 and the second support members 12. In said arrangement, the outer surface of the support members 11, 12 fits seamlessly into the rounding 32 between the rod sections 7, 8, such that the contact surface between the support members 11, 12 and the rounding 32 is maximized. In other variations of the reel support, the outer radius 29 of the support members 11, 12 may also be dimensioned differently, such that they are smaller than the radius 30 of the openings 15 at the side flanges 14 of the reel 13. The support members 11, 12 maybe manufactured out of, for example, a pipe or a solid rod piece.

The invention claimed is:

1. A reel stand, comprising a unitary, substantially U-shaped frame formed of a singular piece by bending, the frame of the reel stand having a first branch and a second branch formed on different sides of a substantially 180 degree turn formed at a middle section of the singular piece, each of said branches comprising:

a planar section, said planar sections of the first and second branches together defining a plane for arranging the frame on a surface, and a support section comprising a first rod section and a second rod section, the first and the second rod sections together forming an angle, wherein both rod sections connect to the respective planar section through the first rod section, and the second rod section comprises an end located on the plane defined by the planar sections for arranging the planar sections and the ends into contact with the surface, and a first support member and a second support member are provided coaxially in the respective first and the second branch, the first and the second support member extending from the respective first and the second branch towards each other at the support sections to form a contact with openings on side flanges of a reel to be arranged between them, so as to receive the reel in the reel stand in a rotating manner.

2. The reel stand according to claim 1, wherein each of the support sections extend at an angle, in relation to the plane defined by the planar sections, and wherein the first and the second support member are arranged to the first and the second branch at the support sections, such that a distance of a rotational axis of the reel to be received in the reel stand in a rotating manner from the plane is greater than a radius of the reel.

3. The reel stand according to claim 1, wherein the first and the second rod section of each support section define together a support plane, a distance between the support planes being at least equal to a width of the reel to be received, a distance between the first and the second support member is smaller than the width of the reel to be received, and the frame of the reel stand is formed of an elastic material such that the distance between the first and the second support member is elastically deflectable by an external force, so as to arrange the reel between the support members.

4. The reel stand according to claim 1, wherein the reel stand further comprises:

an axle having a first end and a second end, the axle is arranged to be attached to the first support member, such that the first end of the axle extends towards the second support member, and an axle support, the axle support is arranged to be attached to the second support member such that a recess opens to the surface of the axle support towards the first support member for receiving the first end of the axle.

5. The reel stand according to claim 4, wherein the second end of the axle extends from the first support member opposite to the first end of the axle past the first support member, and the axle support comprises a protrusion extending away from the first support member past the second support member.

6. The reel stand according to claim 1, wherein the reel stand further comprises:

an axle and an axle bushing attached thereto between a first end and a second end of the axle, the axle bushing is dimensioned to be placed gaplessly around the first support member to attach the axle to the first support member, such that the first end of the axle extends towards the second support member, and an axle support and a support bushing attached thereto, the support bushing is dimensioned to be placed gaplessly around the second support member to attach the axle support to the second support member, such that a recess opens to a surface of the axle support towards the first support member for receiving the first end of the axle.

7. The reel stand according to claim 1, wherein the first and the second support member extend from the first and the second branch at the support sections, such that each support member is in contact with the first and the second rod section of each respective the support section.

8. The reel stand according to claim 1, wherein both of the first and the second support member are formed of a cylindrical piece.

9. The reel stand according to claim 8, wherein a rounding is provided between the first and the second rod section of each support section, the rounding having a rounding radius which substantially corresponds to an outer radius of the first and the second support members.

10. The reel stand according to claim 1, wherein the angle formed by the first and the second rod section of each support section has a magnitude of 20 to 90 degrees.

11. The reel stand according to claim 1, wherein each of the support sections extend at a right angle in relation to the plane defined by the planar sections, and —wherein the first and the second support member are arranged to the first and the second branch at the support sections, such that a distance of a rotational axis of the reel to be received in the reel stand in a rotating manner from the plane is greater than a radius of the reel.

* * * * *